US008029596B2

(12) United States Patent
Arrell et al.

(10) Patent No.: US 8,029,596 B2
(45) **Date of Patent: *Oct. 4, 2011**

(54) METHOD OF MAKING RARE-EARTH STRENGTHENED COMPONENTS

(75) Inventors: Douglas J. Arrell, Oviedo, FL (US); Allister W. James, Orlando, FL (US); Anand A. Kulkarni, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 392 days.

This patent is subject to a terminal disclaimer.

(21) Appl. No.: 12/194,154

(22) Filed: Aug. 19, 2008

(65) Prior Publication Data

US 2010/0043597 A1 Feb. 25, 2010

(51) Int. Cl.
*B22F 9/08* (2006.01)

(52) U.S. Cl. ..... 75/338; 148/513

(58) Field of Classification Search ..... None
See application file for complete search history.

(56) References Cited

U.S. PATENT DOCUMENTS

| | | | | |
|---|---|---|---|---|
| 3,653,987 | A * | 4/1972 | Boesch | 148/675 |
| 3,873,347 | A | 3/1975 | Walker et al. | 117/71 M |
| 4,168,182 | A | 9/1979 | Rossmann et al. | |
| 4,340,425 | A | 7/1982 | Frosch et al. | 148/428 |
| 4,485,151 | A | 11/1984 | Stecura | 428/633 |
| 6,753,084 | B2 * | 6/2004 | Maekawa et al. | 428/842.3 |
| 6,875,464 | B2 | 4/2005 | Ruud et al. | 427/142 |
| 7,157,151 | B2 | 1/2007 | Creech et al. | 428/621 |
| 2007/0202002 | A1 | 8/2007 | James et al. | 420/443 |
| 2007/0215837 | A1 * | 9/2007 | Chiruvolu et al. | 252/301.4 R |
| 2008/0026242 | A1 | 1/2008 | Quadakkers et al. | 428/551 |
| 2008/0142126 | A1 | 6/2008 | Gigliotti et al. | |

OTHER PUBLICATIONS

L. V. Ramanathan; "Role of Rare-Earth Elements on High Temperature Oxidation Behavior of Fe-Cr, Ni-Cr and Ni-Cr-Al Alloys"; Corrosion Science, 1993; vol. 35, Nos. 5-8, pp. 871-878; Pergamon Press Ltd., Great Britain.

* cited by examiner

*Primary Examiner* — George Wyszomierski

(57) ABSTRACT

A method of manufacturing a metallic component includes atomizing, in an inert atmosphere, a metallic liquid having at least one rare-earth element and at least one non rare-earth element to form a metallic powder. A series of heat treating steps are performed on the metallic powder. A first heat treating step is performed in an oxidizing atmosphere, and a second heat treating step is performed in an inert atmosphere. A third heat treating step is performed in a reducing atmosphere to form a metallic power having an increased proportion of rare-earth oxides compared to non rare-earth oxides. The metallic component is formed from the metallic powder having the increased proportion of rare-earth oxides compared to non rare-earth oxides.

27 Claims, 3 Drawing Sheets

METHOD OF MAKING RARE-EARTH STRENGTHENED COMPONENTS

FIELD OF THE INVENTION

The present invention relates to the field of metallurgy, and, more particularly, to methods for making rare-earth strengthened metallic components.

BACKGROUND OF THE INVENTION

Components of combustion turbines are routinely subjected to harsh environments that include rigorous mechanical loading conditions at high temperatures, high temperature oxidization, and exposure to corrosive media. The structural stability of such components is often provided by nickel or cobalt base superalloys, for example, due to their exemplary high temperature mechanical properties such as creep resistance and fatigue resistance.

Creep is the term used to describe the tendency of a solid material to slowly move or deform permanently to relieve stresses. It occurs as a result of long-term exposure to levels of stress that are below the yield strength or ultimate strength of the material. Creep is more severe in materials that are subjected to heat for long periods and near their melting point, such as alloys out of which combustion turbine components are formed. If a turbine blade, for example, were to deform so that it contacted the turbine cylinder, a catastrophic failure may result. Therefore, a high creep resistance is an advantageous property for a combustion turbine component to possess.

Fatigue is the progressive and localized structural damage that occurs when a material is subjected to cyclic loading. Given the numerous fatigue cycles a combustion turbine component may endure, a high fatigue resistance is likewise an advantageous property for a combustion turbine component to possess.

One way to strengthen a material, enhancing both its creep resistance and its fatigue resistance, is known as dispersion strengthening. Dispersion strengthening typically occurs by introducing a fine dispersion of particles into a material, for example, a metallic component. Dispersion strengthening can occur by adding material constituents that form particles when the constituents are added over their solubility limits.

Alternatively, dispersion strengthening may be performed by adding stable particles to a material, in which these particles are not naturally occurring in the material. These particles strengthen the material and may remain unaltered during metallurgical processing. Typically, the closer the spacing of the particles, the stronger the material. The fine dispersion of close particles restricts dislocation movement, which is the mechanism by which creep rupture may occur.

Previous dispersion strengthening methods include the introduction of thoria, alumina, or yttria particles into materials out of which combustion turbine components are formed. Thoria, alumina, and yttria are oxides of rare-earth elements that possess a higher bond energy than oxides of metals such as iron, nickel, aluminum, or chromium that are typically used as the base metal of combustion turbine components.

For example, U.S. Pat. No. 5,049,355 to Gennari et al. discloses a process for producing a dispersion strengthened alloy of a base metal. A base metal powder and a powder comprising thoria, alumina, and/or yttria are pressed into a blank form. The pressed blank form is sintered so that the thoria, alumina, and/or yttria are homogenously dispersed throughout the base metal.

U.S. Pat. No. 5,868,876 to Biano et al. discloses a process for producing a creep resistant molybdenum alloy. A slurry of molybdenum oxide and an aqueous solution of lanthanum, cerium, and/or thoria is formed. The slurry is heated in a hydrogen atmosphere to produce a metallic powder. The powder is pressed then sintered. Finally, the sintered powder is thermomechanically processed to produce a molybdenum alloy having an oxide dispersion of lanthanum, cerium, and/or thoria.

U.S. Pat. No. 6,231,807 to Berglund discloses a method of producing a dispersion hardened FeCrAl alloy. A starting powder including iron, chromium, and titanium and/or yttrium is mixed with a chromium nitride powder. The powder mixture is placed into an evacuated container and heat treated. During heat treatment, titanium nitride is formed in a mix of chromium and iron. The nitrided chromium and iron product is then alloyed with aluminum by a conventional process to form a dispersion strengthened FeCrAl alloy.

The pursuit of increased combustion turbine efficiency has led to increased turbine section inlet temperatures, and thus metallic components made from different materials and having increased high temperature creep and fatigue resistance may be desirable.

SUMMARY OF THE INVENTION

In view of the foregoing background, it is therefore an object of the present invention to provide a method of manufacturing a strengthened metallic component.

This and other objects, features, and advantages in accordance with the present invention are provided by a method of manufacturing a metallic component including atomizing, in an inert atmosphere, a metallic liquid comprising at least one rare-earth element and at least one non rare-earth element to form a metallic powder. Moreover, a series of heat treating steps may be performed on the metallic powder. A first heat treating step may be performed in an oxidizing atmosphere and a second heat treating step may be performed, for example, in an inert atmosphere. A third heat treating step may be performed in a reducing atmosphere to form a metallic power having an increased proportion of rare-earth oxides compared to non rare-earth oxides. The metallic component may be formed from the metallic powder having the increased proportion of rare-earth oxides compared to non rare-earth oxides.

An increased proportion of rare-earth oxides advantageously provides the metallic component with the increased creep resistance and the increased fatigue resistance that results from the exemplary thermodynamic stability of rare-earth oxides. Moreover, the rare-earth oxides provide the metallic component with improved high temperature oxidation resistance.

Forming the metallic component may comprise forming a combustion turbine component. Additionally, atomizing, in an inert atmosphere, a metallic liquid comprising at least one rare-earth element and one non rare-earth element in an inert atmosphere to form a metallic powder may comprise atomizing, in an inert atmosphere, a metallic liquid comprising at least one rare-earth element and one non rare-earth element in an inert atmosphere to form a crystalline metallic powder. Alternatively, the atomizing may be carried out to form an amorphous metallic powder.

The metallic powder may be milled to form a nanosized metallic powder. Likewise, the metallic powder having the increased proportion of rare-earth oxides compared to non rare-earth oxides may be milled to form a nanosized metallic powder having the increased proportion of rare-earth oxides compared to non rare-earth oxides.

The first heat treating step may be performed for a first period of time, and the second heat treating step may be performed for a second period of time. The second period of time may be greater than the first period of time. In some embodiments, the second heat treating step may be performed in a vacuum.

The metallic liquid may comprise between 0.1% and 10% by weight of rare-earth elements. Furthermore, the at least one non rare-earth element may comprise at least one of nickel, cobalt, chromium, aluminum, and iron. In some embodiments, the metallic liquid may include at least 50% nickel by weight. In other embodiments, the metallic liquid may include at least 50% cobalt by weight. The reducing atmosphere may comprise hydrogen, and the oxidizing atmosphere may comprise argon and oxygen.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

Figure 1:
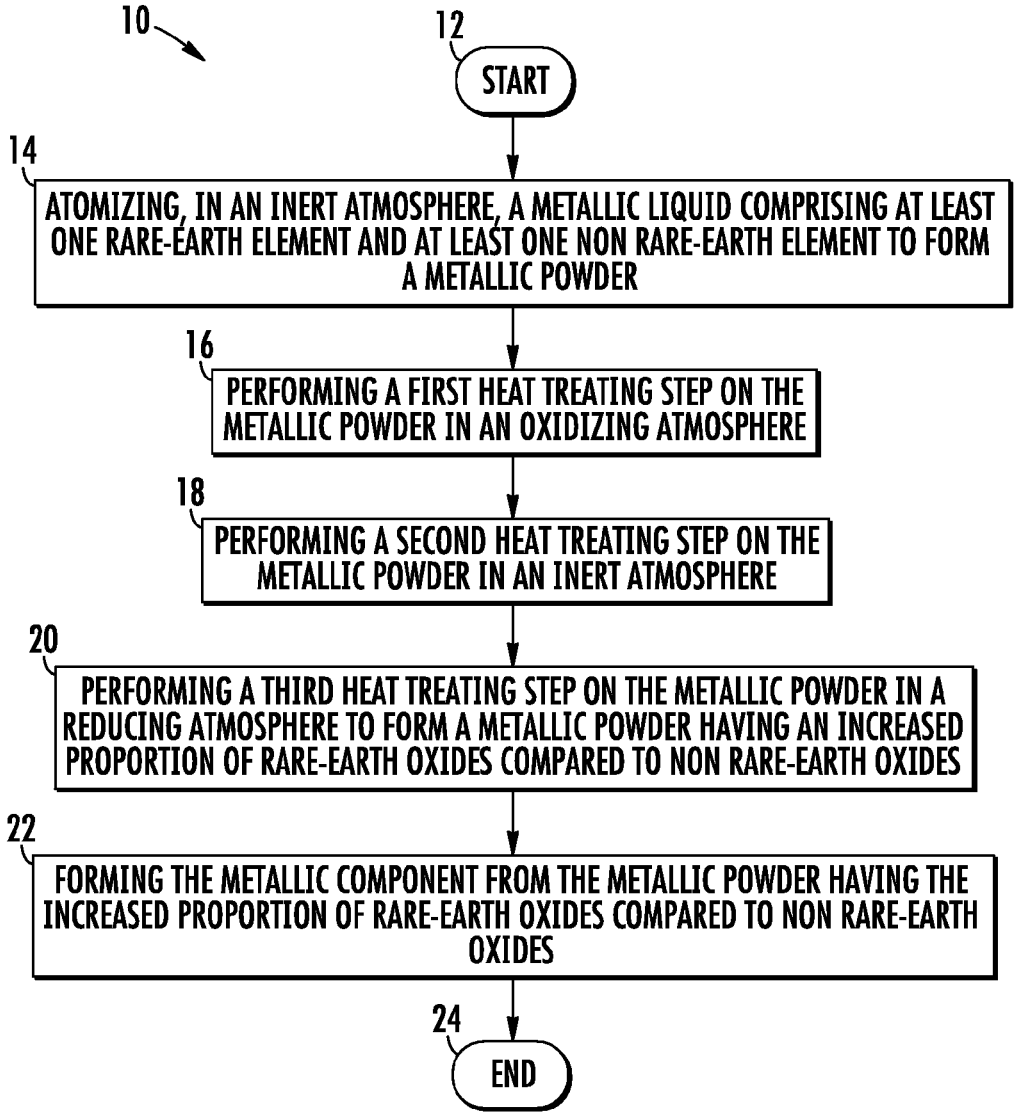
FIG. 1 is a flowchart of a method in accordance with the present invention.

A first embodiment of a method of manufacturing a metallic component in accordance with the present invention is now described generally with reference to the flowchart 10 of FIG. 1. After the start (Block 12), at Block 14, a metallic liquid comprising at least one rare-earth element and at least one non rare-earth element is atomized in an inert atmosphere to form a metallic powder. Particle size distribution of the metallic powder is preferably in a range of 10 μm to 100 μm, for example. The inert atmosphere preferably comprises nitrogen and/or argon, although it is to be understood that other inert atmospheres may be used. Atomization in such an inert atmosphere may increase the likelihood that each droplet or particle formed during the atomization process has a uniform size, shape, and/or chemistry. As will be discussed in detail below, an exemplary starting metallic liquid comprises a nickel base and at least one rare-earth element such as Nd, Dy, Pr, or Gd. Other preferred metallic liquids include a cobalt base and at least one rare-earth element.

Those skilled in the art will appreciate that the metallic liquid may be formed by melting ingots of a pure metal or of a desired alloy. Moreover, the metallic liquid may be formed by melting ingots of different metals, mixing when melted or during melting to form a metallic liquid containing an alloy. Furthermore, the metallic liquid may be formed by melting a metallic powder. Various processes may be used to melt the ingots or powder.

At Block 16, a first heat treating step is performed on the metallic powder in an oxidizing atmosphere. The first heat treating step is preferably performed in a furnace. The first heat treating step may be performed for a first time period in a range of about 30 to 120 minutes, and more preferably about 45 to 60 minutes. Furthermore, the first heat treating step may be performed and at a first temperature range of about 900 to 1200 C, and more preferably about 1000 to 1100 C, with a concentration of oxygen in a range of 3 to 25% and more preferably about 4 to 8% at ambient pressure. It will be appreciated by those of skill in the art that the first heat treating step may be performed for other time periods, at other temperatures, and at other pressures.

This first heat treating step forms a metallic powder with a fine coating of oxides and/or nitrides. Applicants theorize without wishing to be bound thereto that, at this point, due to the small percentage by weight of rare-earth elements and the comparatively slow diffusivity of rare-earth atoms, the oxides and/or nitrides formed contain mainly non rare-earth elements.

At Block 18, a second heat treating step is performed on the metallic powder in an inert atmosphere. Applicants theorize without wishing to be bound thereto that this allows extensive diffusion to occur and that the greater thermodynamic stability of rare-earth oxides as opposed to the non rare-earth oxides will result in a reduction of the pre-existing oxides and/or nitrides and an increase of rare-earth oxides.

The second heat treating step may be performed for a second time period in a range of about 120 to 300 minutes, and more preferably about 180 to 240 minutes. Moreover, the second heat treating step may be performed and at a second temperature range of about 1100 to 1300 C, and more preferably about 1150 to 1250 C, and at ambient pressure. It will be appreciated by those of skill in the art that the second heat treating step may be performed for other time periods, at other temperatures, and at other pressures.

At Block 20, a third heat treating step is performed on the metallic powder in a reducing atmosphere to form a metallic powder having an increased proportion of rare-earth oxides compared to non rare-earth oxides. It will be appreciated by those of skill in the art that the rare-earth oxides formed may be nanosized. The third heat treating step may be performed for a third time period in a range of about 30 to 120 minutes, and more preferably about 45 to 60 minutes. Furthermore, the third heat treating step may be performed and at a third temperature range of about 800 to 1200 C, and more preferably about 900 to 1100 C, with a concentration of hydrogen in a range of 10 to 99% and more preferably about 20 to 95% at ambient pressure. It will be appreciated by those of skill in the art that the third heat treating step may be performed for other time periods, at other temperatures, and at other pressures.

Applicants theorize without wishing to be bound thereto that this third heat treating, or annealing, step is performed to improve the bonds formed by the metallic powder in subsequent processes and to reduce the amount of detrimental oxides, such as chromia and iron oxide, as much as possible. The reducing atmosphere reduces the amount of remaining surface oxides and/or nitrides but lacks sufficient thermodynamic stability to reduce the rare-earth oxides.

At Block 22, a metallic component is formed from the metallic powder having the increased proportion of rare-earth oxides compared to non rare-earth oxides. It is to be understood that the metallic component may be formed by conventional processes such as compaction, forging, rolling, etc. Moreover, after formation, the metallic component may be heat treated in a desired atmosphere, such as an inert atmosphere or an oxidizing atmosphere, at a desired temperature and at a desired pressure.

Applicants theorize without wishing to be bound thereto that the increased proportion of rare-earth oxides advantageously provides the metallic component with increased creep resistance and increased fatigue resistance. Moreover, the rare-earth oxides may provide the metallic component with improved high temperature oxidation resistance. These desirable properties may result from the exemplary thermodynamic stability and high bond energy of rare-earth oxides.

Figure 2:
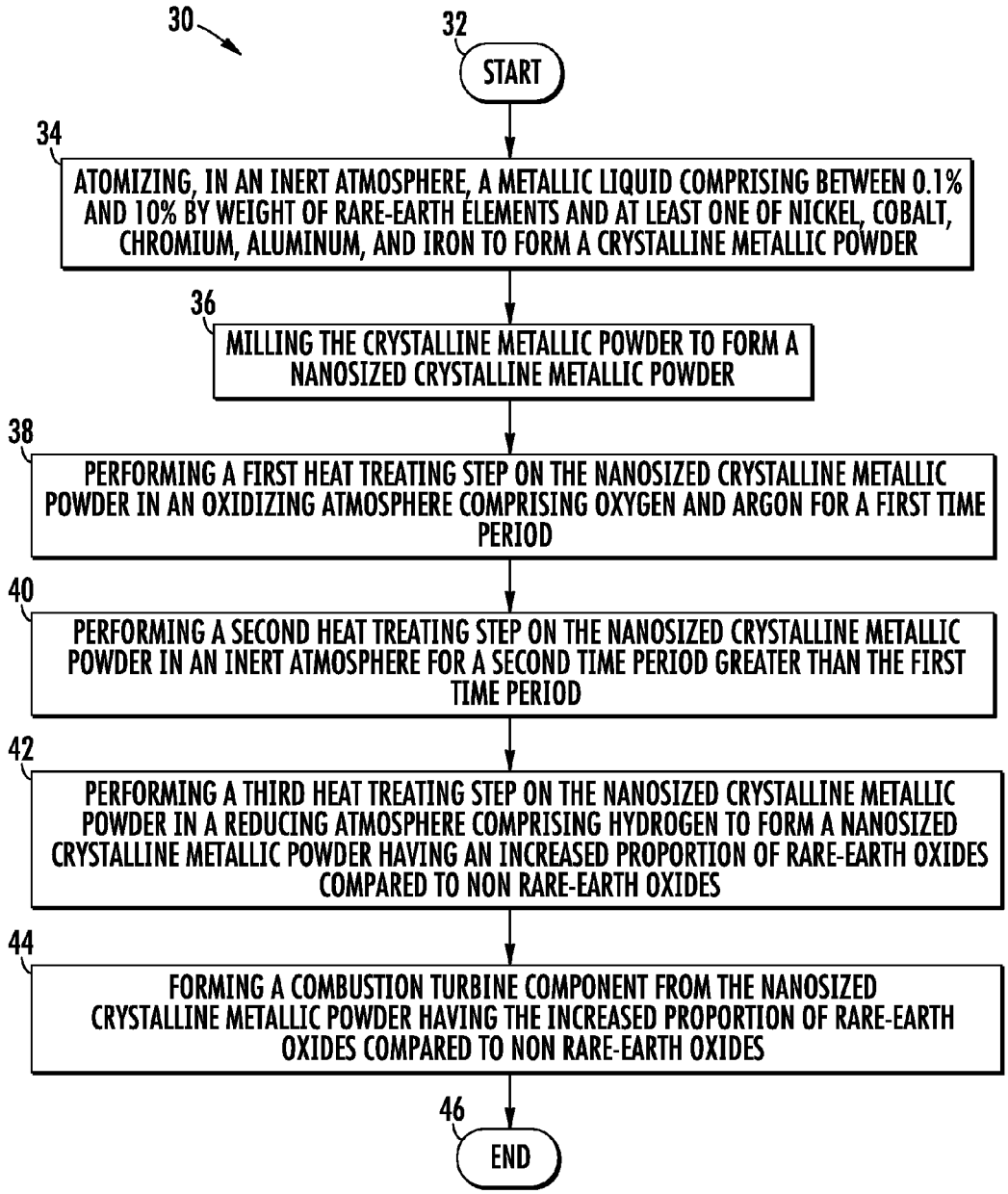
FIG. 2 is a flowchart of an alternative embodiment of a method in accordance with the present invention.

Referring now to the flowchart 30 of FIG. 2, an alternative embodiment of a method of manufacturing a turbine component is now described. After the start (Block 32), at Block 34 a metallic liquid comprising between 0.1% and 10% by weight of rare-earth elements and at least one of nickel, cobalt, chromium, aluminium, and iron is atomized in an inert atmosphere to form a crystalline metallic powder. It will be appreciated by those skilled in the art that the metallic liquid may include other percentages by weight of rare-earth elements and other metallic elements. Ceramics may likewise be included.

Additionally, at Block 36, the crystalline metallic powder may be milled to form a nanosized crystalline metallic powder. The crystalline metallic powder may be milled for a desired length of time and according to one or more conventional milling processes as understood by those skilled in the art. Furthermore, the crystalline metallic powder may be milled multiple times by the same milling process, or may alternatively be milled multiple times by different milling processes.

At Block 38, a first heat treating step is performed on the nanosized crystalline metallic powder in an oxidizing atmosphere comprising oxygen and argon for a first time period. Those of skill in the art will appreciate that other oxidizing atmospheres may be used, and that such oxidizing atmospheres may be at desired temperatures and desired pressures.

Furthermore, at block 40, a second heat treating step is performed on the nanosized crystalline metallic powder in an inert atmosphere for a second time period greater than the first time period. As discussed above, Applicants theorize without wishing to be bound thereto that the first heat treating step forms a metallic powder with a fine coating of oxides and/or nitrides, with only a small percentage of the oxides and/or nitrides being rare-earth elements due to the comparatively slow diffusivity of rare-earth atoms. As also discussed above, Applicants theorize without wishing to be bound thereto that the second heat treating step may allow extensive diffusion to occur, and thus the formation of a greater percentage of rare-earth oxides. The second heat treating step may therefore be performed for a greater time period than the first heat treating step to facilitate this diffusion process.

Moreover, at Block 42, a third heat treating step is performed on the nanosized crystalline metallic powder in a reducing atmosphere comprising hydrogen to form a nanosized crystalline metallic powder having an increased proportion of rare-earth oxides compared to non rare-earth oxides. It is to be understood that other reducing atmospheres may be used.

At Block 44, a combustion turbine component is formed from the nanosized crystalline metallic powder having the increased proportion of rare-earth oxides compared to non rare-earth oxides. It will be readily understood by those of skill in the art that the combustion turbine component could be, for example, a compressor vane, a turbine blade, a casing, a blade ring, an airfoil, a diaphragm, or a diffuser.

Figure 3:
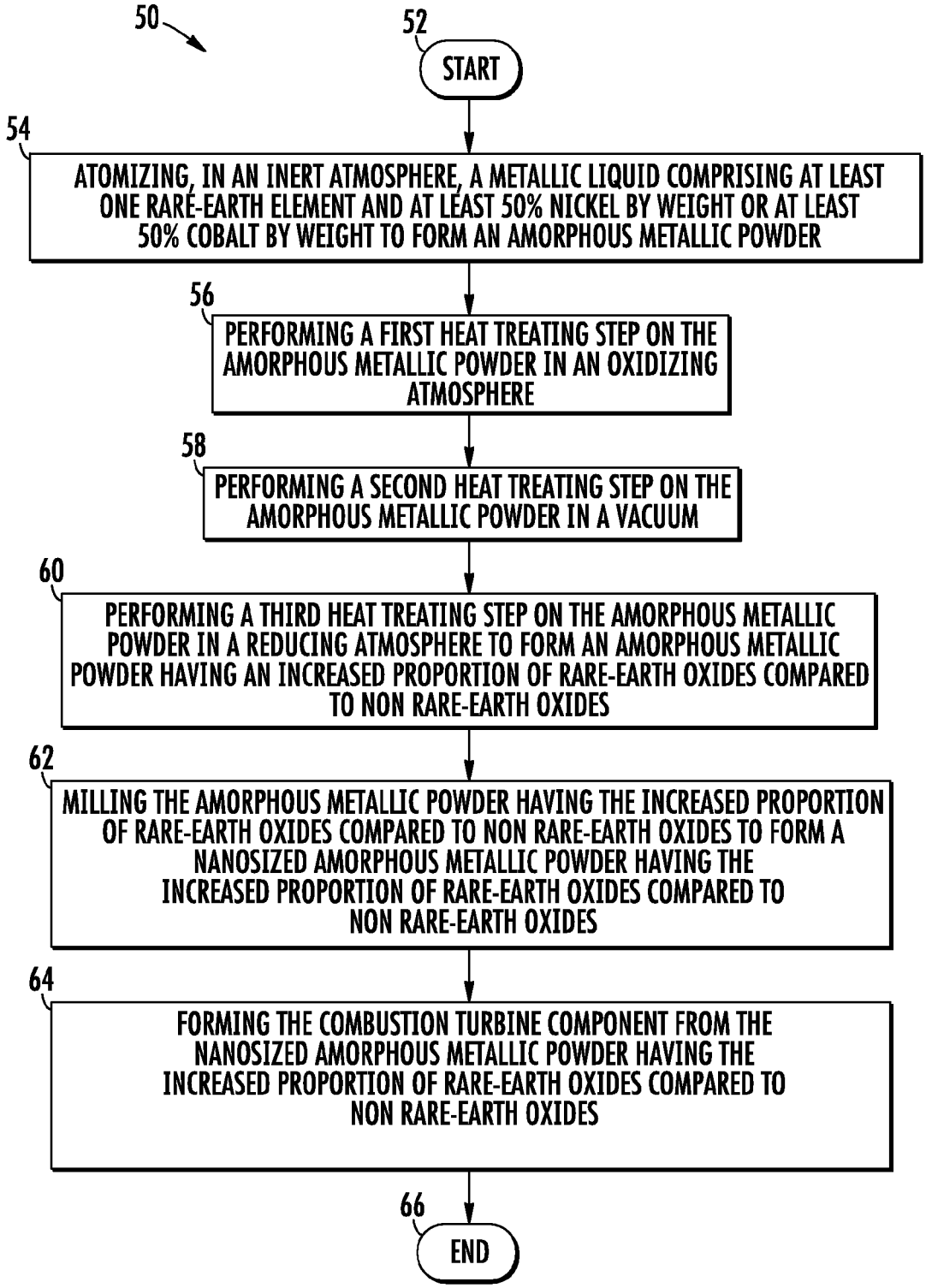
FIG. 3 is a flowchart of yet another embodiment of a method in accordance with the present invention.

Referring now to the flowchart 50 of FIG. 3, yet another embodiment of a method of manufacturing a combustion turbine component is now described. After the start (Block 52), at Block 54 a metallic liquid comprising at least one rare-earth element, and at least 50% nickel by weight or at least 50% cobalt by weight, are atomized in an inert atmosphere to form an amorphous metallic powder.

At Block 56, a first heat treating step is performed on the amorphous metallic powder in an oxidizing atmosphere. Additionally, at Block 58, a second heat treating step is performed on the amorphous metallic powder in a vacuum. Furthermore, at Block 60, a third heat treating step is performed on the amorphous metallic powder in a reducing atmosphere to form an amorphous metallic powder having an increased proportion of rare-earth oxides compare to non rare-earth oxides.

Moreover, at Block 62, the amorphous metallic powder having the increased proportion of rare-earth oxides compared to non rare-earth oxides is milled to form a nanosized amorphous metallic powder having the increased proportion of rare-earth oxides compared to non rare-earth oxides. Finally, at Block 64, a combustion turbine component is formed from the nanosized amorphous metallic powder having the increased proportion of rare-earth oxides compared to non rare-earth oxides. Forming the combustion turbine component from nanosized amorphous metallic powder, or in other embodiments nanosized metallic powder, may improve various physical properties of the combustion turbine component.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A method of manufacturing a metallic component comprising:

atomizing a metallic liquid comprising at least one rare-earth element and at least one non rare-earth element to form a metallic powder;

performing a series of heat treating steps on the metallic powder comprising a first heat treating step performed in an oxidizing atmosphere, a second heat treating step performed in an inert atmosphere, and a third heat treating step performed in a reducing atmosphere to form a metallic power having an increased proportion of rare-earth oxides compared to non rare-earth oxides; and forming the metallic component from the metallic powder having the increased proportion of rare-earth oxides compared to non rare-earth oxides.

2. The method of claim 1 wherein atomizing a metallic liquid comprising at least one rare-earth element and at least one non rare-earth element to form a metallic powder comprises atomizing, in an inert atmosphere, at least one rare-earth element and at least one non rare-earth element to form a metallic powder.

3. The method of claim 1 wherein forming the metallic component comprises forming a combustion turbine component.

4. The method of claim 1 wherein atomizing a metallic liquid comprising at least one rare-earth element and one non rare-earth element to form a metallic powder comprises atomizing a metallic liquid comprising at least one rare-earth element and one non rare-earth element in an inert atmosphere to form a crystalline metallic powder.

5. The method of claim 1 wherein atomizing a metallic liquid comprising at least one rare-earth element and one non rare-earth element to form a metallic powder comprises atomizing a metallic liquid comprising at least one rare-earth element and one non rare-earth element in an inert atmosphere to form an amorphous metallic powder.

6. The method of claim 1 further comprising milling the metallic powder to form a nanosized metallic powder.

7. The method of claim 1 further comprising milling the metallic powder having the increased proportion of rare-earth oxides compared to non rare-earth oxides to form a nanosized metallic powder having the increased proportion of rare-earth oxides compared to non rare-earth oxides.

8. The method of claim 1 wherein the first heat treating step is performed for a first period of time; and wherein the second heat treating step is performed for a second period of time; and wherein the second period of time is greater than the first period of time.

9. The method of claim 1 wherein the metallic liquid comprises between 0.1% and 10% by weight of rare-earth elements.

10. The method of claim 1 wherein the at least one non rare-earth element comprises at least one of nickel, cobalt, chromium, aluminum, and iron.

11. The method of claim 1 wherein the metallic liquid comprises at least 50% nickel by weight.

12. The method of claim 1 wherein the metallic liquid comprises at least 50% cobalt by weight.

13. The method of claim 1 wherein the reducing atmosphere comprises hydrogen.

14. The method of claim 1 wherein the oxidizing atmosphere comprises argon and oxygen.

15. A method of manufacturing a combustion turbine component comprising:

atomizing, in an inert atmosphere, a metallic liquid comprising at least one rare-earth element and at least one non rare-earth element to form a metallic powder;

performing a series of heat treating steps on the metallic powder comprising a first heat treating step performed in an oxidizing atmosphere, a second heat treating step performed in a vacuum, and a third heat treating step performed in a reducing atmosphere to form a metallic power having an increased proportion of rare-earth oxides compared to non rare-earth oxides; and forming the combustion turbine component from the metallic powder having the increased proportion of rare-earth oxides compared to non rare-earth oxides.

16. The method of claim 15 wherein atomizing a metallic liquid comprising at least one rare-earth element and one non rare-earth element in an inert atmosphere to form a metallic powder comprises atomizing, in an inert atmosphere, a metallic liquid comprising at least one rare-earth element and one non rare-earth element in an inert atmosphere to form a crystalline metallic powder.

17. The method of claim 15 wherein atomizing a metallic liquid comprising at least one rare-earth element and one non rare-earth element in an inert atmosphere to form a metallic powder comprises atomizing, in an inert atmosphere, a metallic liquid comprising at least one rare-earth element and one non rare-earth element in an inert atmosphere to form an amorphous metallic powder.

18. The method of claim 15 further comprising milling the metallic powder to form a nanosized metallic powder.

19. The method of claim 15 further comprising milling the metallic powder having the increased proportion of rare-earth oxides compared to non rare-earth oxides to form a nanosized metallic powder having the increased proportion of rare-earth oxides compared to non rare-earth oxides.

20. The method of claim 15 wherein the first heat treating step is performed for a first period of time; and wherein the second heat treating step is performed for a second period of time; and wherein the second period of time is greater than the first period of time.

21. The method of claim 15 wherein the metallic liquid comprises between 0.1% and 10% by weight of rare-earth elements.

22. The method of claim 15 wherein the at least one non rare-earth element comprises at least one of nickel, cobalt, chromium, aluminum, and iron.

23. A method of manufacturing a combustion turbine component comprising:

atomizing, in an inert atmosphere, a metallic liquid comprising at least one rare-earth element and at least one non rare-earth element to form a metallic powder;

performing a series of heat treating steps on the metallic powder comprising a first heat treating step performed in an oxidizing atmosphere for a first time period, a second heat treating step performed in an inert atmosphere for a second time period greater than the first time period, and a third heat treating step performed in a reducing atmosphere to form a metallic power having an increased proportion of rare-earth oxides compared to non rare-earth oxides; and forming the combustion turbine component from the metallic powder having the increased proportion of rare-earth oxides compared to non rare-earth oxides.

24. The method of claim 23 further comprising milling the metallic powder to form a nanosized metallic powder.

25. The method of claim 23 further comprising milling the metallic powder having the increased proportion of rare-earth oxides compared to non rare-earth oxides to form a nanosized metallic powder having the increased proportion of rare-earth oxides compared to non rare-earth oxides.

26. The method of claim 23 wherein the metallic liquid comprises between 0.1% and 10% by weight of rare-earth elements.

27. The method of claim 23 wherein the at least one non rare-earth element comprises at least one of nickel, cobalt, chromium, aluminum, and iron.

* * * * *